US009291437B2

(12) United States Patent
Bonnstetter et al.

(10) Patent No.: US 9,291,437 B2
(45) Date of Patent: Mar. 22, 2016

(54) RADIAL FIRING WARHEAD SYSTEM AND METHOD

(75) Inventors: Gabriel Bonnstetter, Maple Grove, MN (US); Kenneth Fink, Elk River, MN (US); Jake Carroll, Crystal, MN (US); Richard Truitt, Champlin, MN (US)

(73) Assignee: ORBITAL ATK, INC., Plymouth, MN (US)

( * ) Notice: Subject to any disclaimer, the term of this patent is extended or adjusted under 35 U.S.C. 154(b) by 216 days.

(21) Appl. No.: 13/486,941

(22) Filed: Jun. 1, 2012

(65) Prior Publication Data

US 2014/0230682 A1 Aug. 21, 2014

(51) Int. Cl.

| | |
|---|---|
| ***F42B 12/24*** | (2006.01) |
| ***F42B 33/00*** | (2006.01) |
| ***F42B 12/26*** | (2006.01) |
| ***F42B 12/32*** | (2006.01) |

(52) U.S. Cl.
CPC ..... *F42B 12/24* (2013.01); *F42B 12/26* (2013.01); *F42B 12/32* (2013.01)

(58) Field of Classification Search
CPC ..... F42B 12/201; F42B 12/205; F42B 12/22; F42B 12/24; F42B 12/26; F42B 12/32
USPC ..... 102/311, 389, 475, 491, 492, 493, 494, 102/495, 496, 497
See application file for complete search history.

(56) References Cited

U.S. PATENT DOCUMENTS

| | | | | | |
|---|---|---|---|---|---|
| 3,677,183 | A * | 7/1972 | Talley | 102/495 |
| 3,853,060 | A * | 12/1974 | Weeding | 102/495 |
| 4,004,518 | A * | 1/1977 | Potteiger et al. | 102/495 |
| H238 | H * | 3/1987 | Adams | 102/493 |
| 4,982,668 | A * | 1/1991 | Bender et al. | 102/495 |
| 5,040,464 | A * | 8/1991 | Pearson | 102/493 |
| 5,131,329 | A * | 7/1992 | Lips et al. | 102/364 |
| 5,157,225 | A * | 10/1992 | Adams et al. | 102/493 |
| 6,484,642 | B1 * | 11/2002 | Kuhns et al. | 102/493 |
| 6,817,299 | B1 * | 11/2004 | Cooke | 102/493 |
| 7,093,542 | B2 * | 8/2006 | Gousman et al. | 102/493 |
| 7,743,707 | B1 * | 6/2010 | Melin et al. | 102/493 |
| 8,161,884 | B1 * | 4/2012 | Kokodis et al. | 102/493 |
| 2001/0004868 | A1 * | 6/2001 | Burckhardt et al. | 102/493 |
| 2004/0244629 | A1 * | 12/2004 | Jopson | 102/508 |
| 2005/0087088 | A1 * | 4/2005 | Lacy et al. | 102/495 |
| 2009/0211484 | A1 * | 8/2009 | Truitt et al. | 102/497 |

* cited by examiner

*Primary Examiner* — Bret Hayes
(74) *Attorney, Agent, or Firm* — TraskBritt

(57) ABSTRACT

A warhead system, method and apparatus. A warhead includes a liner having a longitudinal axis that runs down the center of the liner. The liner includes a liner pattern and a liner shape. The liner shape is selected and a radial distance from the longitudinal axis is selected. The liner pattern is warped as a function of the selected distance and the shape of the liner to reduce the effects of spoking in the post-detonation fragmentation pattern at the selected distance. The liner is then formed as a function of the warped liner pattern.

11 Claims, 8 Drawing Sheets

RADIAL FIRING WARHEAD SYSTEM AND METHOD

BACKGROUND

A typical fragmentation warhead, upon detonation, produces a radially expanding pattern of fragments. Characteristic of a pattern produced by this type of warhead is an inconsistent linear grouping of fragments otherwise known as "spoking." Spoking reduces the probability of hit on target, thus limiting the lethality of the warhead.

What is needed is a system and method for reducing the effects of spoking in a radial firing warhead.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In the following detailed description of example embodiments of the disclosure, reference is made to specific examples by way of drawings and illustrations. These examples are described in sufficient detail to enable those skilled in the art to practice the disclosure, and serve to illustrate how the disclosure may be applied to various purposes or embodiments. Other embodiments of the disclosure exist and are within the scope of the disclosure, and logical, mechanical, electrical, and other changes may be made without departing from the subject or scope of the disclosure. Features or limitations of various embodiments of the disclosure described herein, however essential to the example embodiments in which they are incorporated, do not limit the disclosure as a whole, and any reference to the disclosure, its elements, operation, and application do not limit the disclosure as a whole but serve only to define these example embodiments. The following detailed description does not, therefore, limit the scope of the disclosure, which is defined only by the appended claims.

Figure 1B:
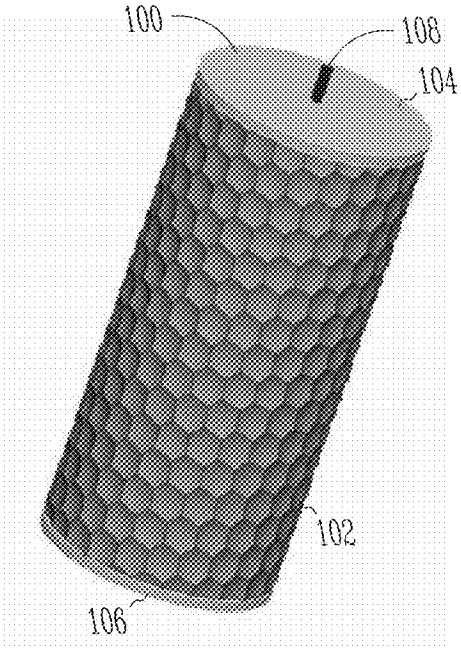
FIGS. 1A, 1B and 2 illustrate a warhead.
Figure 1A:
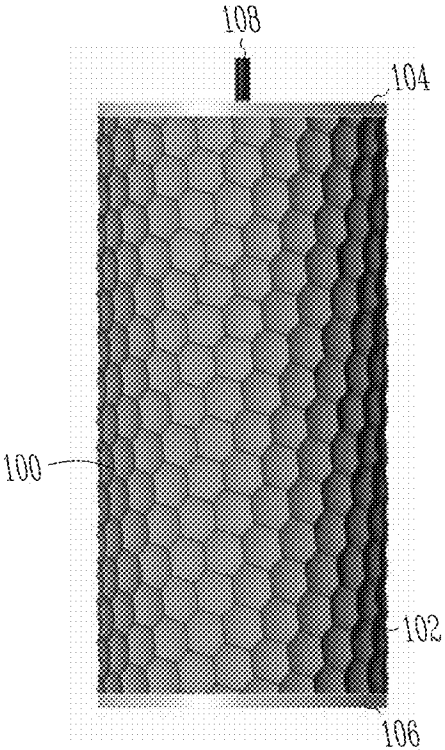

A fragmentation warhead is shown in FIGS. 1A and 1B. Fragmentation warhead 100 is a Multiple Explosively Formed Projectile (MEFP) warhead; it includes an approximately cylindrical liner 102 having a longitudinal axis that runs down the center of the cylinder. Warhead 100 also includes a forward bulkhead 104, an aft bulkhead 106, and a detonator 108. An explosive (not shown) is deposited within liner 102. Liner 102 includes a liner pattern selected to cause the liner 102 to form a plurality of radially expanding projectiles when the explosive is detonated. In the example shown in FIGS. 1A and 1B, a liner pattern of hexagonal dimples is used.

Figure 2:
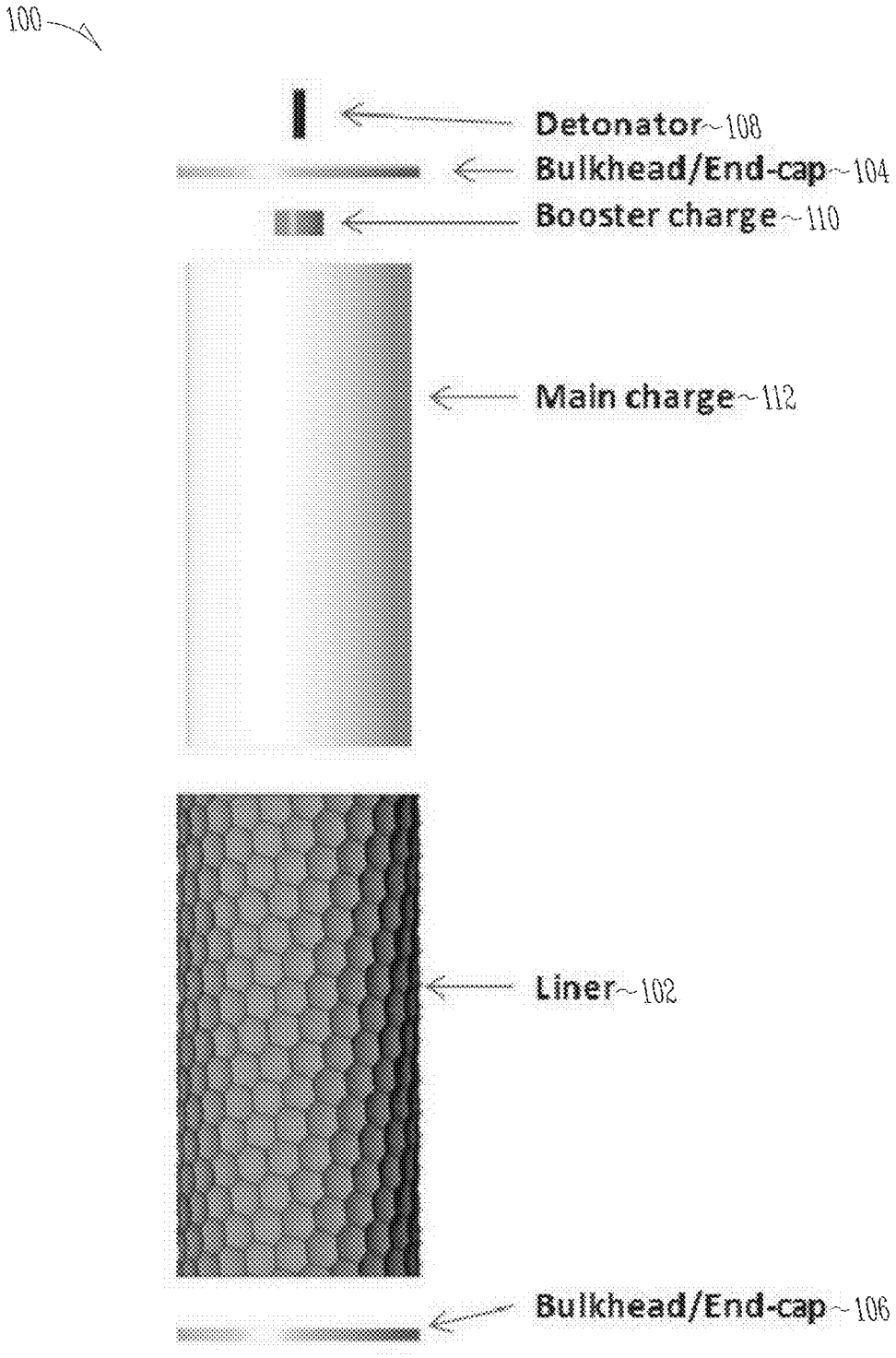

An exploded view of fragmentation warhead 100 from FIGS. 1A and 1B is shown in FIG. 2. Once again, fragmentation warhead 100 includes an approximately cylindrical liner 102 having a longitudinal axis that runs down the center of the cylinder. Warhead 100 also includes a forward bulkhead 104, an aft bulkhead 106, and a detonator 108. Explosive 112 and booster charge 110 are deposited within liner 102 and ignited by detonator 108. Liner 102 includes a liner pattern selected to cause the liner 102 to form a plurality of radially expanding projectiles when the explosive is detonated.

As noted above, a typical fragmentation warhead, upon detonation, produces a radially expanding pattern of fragments. One characteristic of such warheads is that they produce a post-detonation fragmentation pattern having an inconsistent linear grouping of fragments, otherwise known as "spoking." Spoking reduces the probability of hit on target, thus limiting the lethality of the warhead.

Figure 3B:
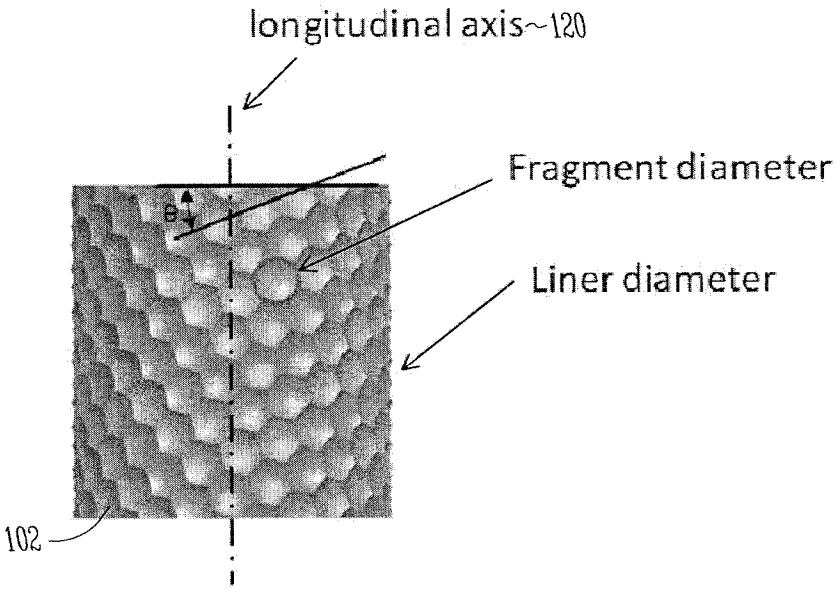
FIGS. 3A and 3B illustrate a warhead liner that can be used in the warhead of FIGS. 1A, 1B and 2.
Figure 3A:
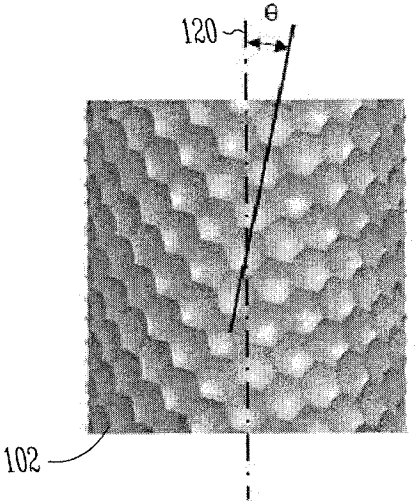

The warhead of FIG. 1 reduces the effects of spoking. An example liner pattern for warhead 100 is shown in FIGS. 3A and 3B. In the example shown in FIGS. 3A and 3B, the MFEP pattern in cylindrical liner 102 is warped relative to the longitudinal axis of the cylindrical liner in order to reduce spoking. In the example shown in FIGS. 3A and 3B, the liner pattern moves in a spiral at an angle θ from a line on the outside surface of the cylindrical liner parallel to a longitudinal axis 120. The liner pattern selected determines the post-detonation fragmentation pattern. In the embodiment shown in FIGS. 3A and 3B, the angle θ is approximately 15 degrees. Other angles can be used as well; the angle θ selected determines where you get an optimal post-detonation fragment distribution as you move radially out from the longitudinal axis of the cylindrical liner. In one example embodiment, angle θ is selected so that the liner pattern repeats every fourth row as you move up cylindrical lining 102.

The angle θ can also be measured normal from the longitudinal axis 120 as is shown in FIG. 3B.

Figure 4B:
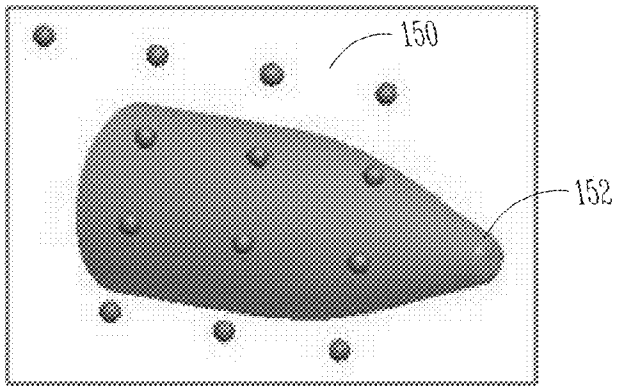
FIG. 4B illustrates impact of the fragmentation pattern of FIG. 4A on a target.
Figure 4A:
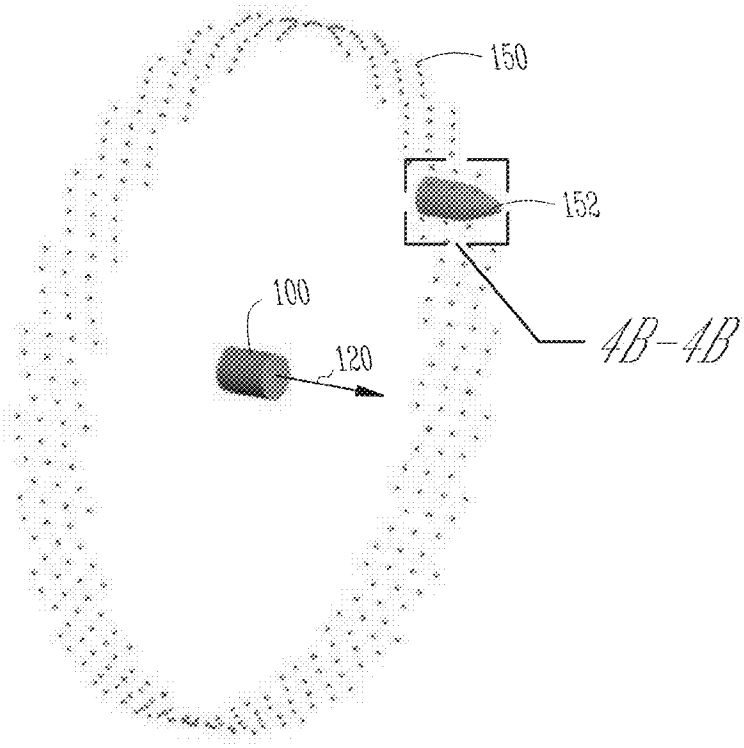
FIG. 4A illustrates a post-detonation fragmentation pattern.

The resulting fragmentation pattern post-detonation is shown in FIGS. 4A and 4B, where you can see that a fragmentation pattern 150 has an approximately uniform distribution with little signs of spoking at the selected distance. An even distribution of fragments enables full lethal potential of the warhead by maximizing probability of a hit on a target 152. It should be noted that as fragment size becomes larger, this approach has even greater impact.

In one embodiment, a liner pattern is selected that repeats a design to form a ring around cylindrical liner 102 and then repeats to form a set of rings moving up cylindrical liner 102. In one example embodiment, each ring is offset radial from its neighbors. In one such embodiment, rings line up every fourth ring.

By warping the warhead liner pattern to compensate for characteristics such as spoking, one can achieve a desired post-detonation fragmentation pattern. The MEFP warhead liners described above provide post-detonation fragmentation patterns that have fragments that are approximately the same quantity and size of the fragments generated by a warhead liner having a similar pattern running parallel to longitudinal axis 120. The process of warping the liner pattern described above relies on skewing, or spiraling, of the fragmentation-inducing geometry relative to the longitudinal axis to reduce spoking. Application of the spiraling to the liner pattern reduces spoking and improves fragment spatial distribution without compromising fragmentation mass and velocity.

The approaches described above can also be used in controlled fragmentation warheads, in warheads having preformed fragments such as ball bearings, and in multiple shaped charge warheads. Multiple shaped charge warheads use a similar approach to that described above but differ in that the dimpling is designed such that the fragments collapse rapidly to form continuously stretching jets, or shaped charge jets. In fragmentation warheads, the warping is applied to the scoring pattern. In warheads with preformed fragments, the warping is realized in the pattern of, e.g., the ball bearings.

These approaches result in improvement in the post-detonation fragmentation pattern without compromising fragment velocity. This improved distribution of fragments enables full lethal potential of the warhead by maximizing the probability of hit on target. As noted above, this approach can be applied to various types of fragmentation warheads including controlled and preformed. Examples of controlled fragmentation include asymmetrical notch and Multiple Explosively Formed Projectile (MEFP) warheads.

Figure 5:
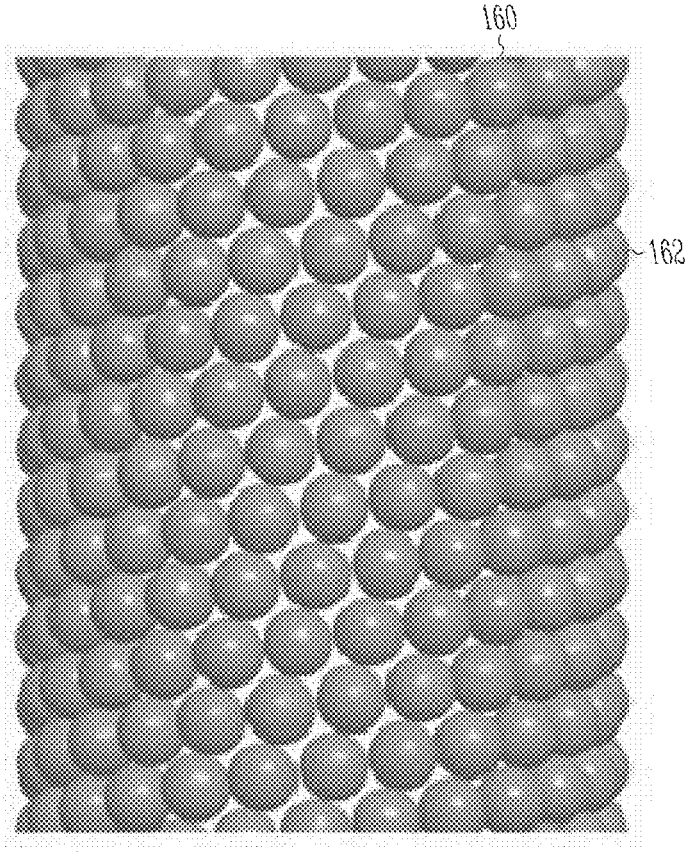
FIGS. 5 and 6 illustrate preformed fragmentation liners.
Figure 6:
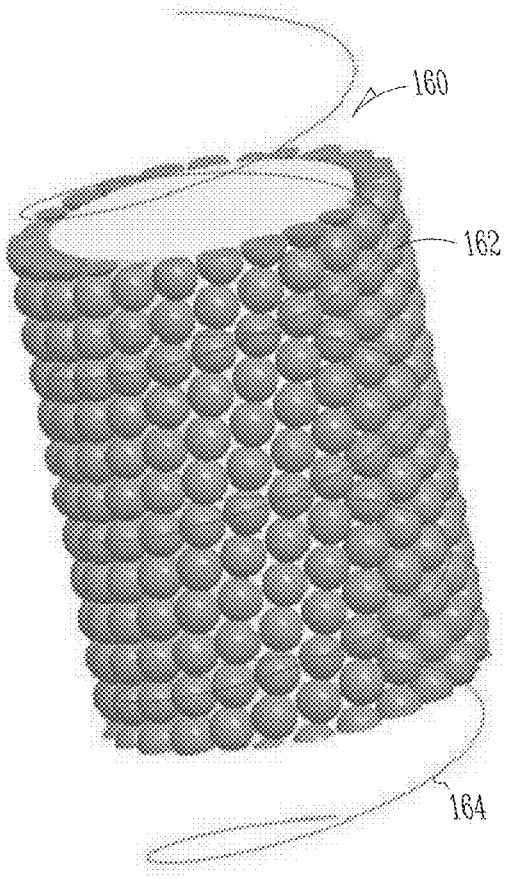

In one example embodiment, for preformed fragmentation warheads, the spiraling is applied to the overall packing of the fragments. In one example embodiment, as is shown in FIG. 5, warhead liner 160 includes bearings 162 that spiral up a cylinder in an approximately 15-degree spiral. A potting material holds the fragments in place. In one embodiment, as is shown in FIG. 6, each warhead liner 160 includes a number of spirals 164 that are offset as shown.

Figure 7B:
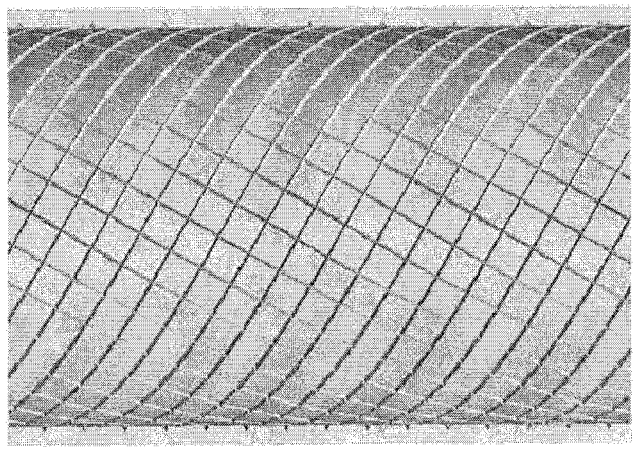
FIGS. 7A and 7B illustrate controlled fragmentation scored liners.
Figure 7A:
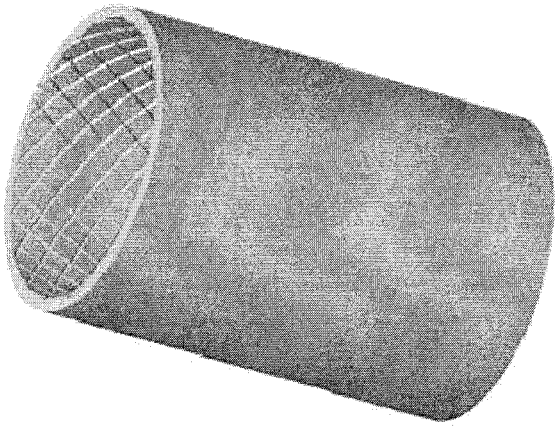

For controlled fragmentation warheads, the spiraling is applied to the liner pattern as is shown in FIGS. 7A and 7B. Several variables guide the selection of the spiral angle, including stand-off requirements of the munition system and warhead characteristics such as liner diameter and individual fragment diameter.

Figure 8:
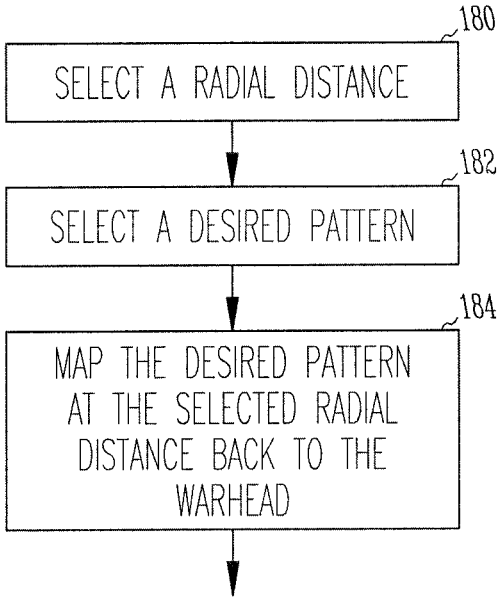
FIG. 8 illustrates a method of forming a pattern for a warhead.

In one embodiment, as is shown in FIG. 8, software is used to model a particular distribution pattern at a selected distance. At 180, a radial distance is selected. The radial distance is the distance radially from the warhead where the desired distribution pattern is needed. At 182, a desired pattern is selected and, at 184, that selected distribution pattern is mapped back on the cylindrical liner to form the pattern to be used. Complex distributions can be achieved in this manner.

In one embodiment, a warhead includes an approximately cylindrical liner with an outside surface and a longitudinal axis that runs down the center of the cylinder; a top end-cap attached to the liner; a bottom end-cap attached to the liner; and an explosive deposited inside the liner. The liner includes a pattern, wherein the pattern is selected to cause the liner to form a plurality of radially expanding projectiles when the explosive is detonated and wherein the pattern includes a repeating pattern, which reduces spoking.

In one embodiment, the pattern defines areas that form explosively formed projectiles when the explosive is detonated.

In one embodiment, the liner is a controlled fragmentation scored liner scored on the inside with the pattern. In one such embodiment, the liner is scored on the inside with the pattern and wherein the pattern moves in a spiral around the longitudinal axis.

In one embodiment, the liner is a preformed fragmentation liner that is composed of discrete fragments imbedded into a potting material to maintain its form. This preformed fragmentation liner is formed into the pattern, wherein the pattern moves in a spiral around the longitudinal axis.

In one embodiment, the pattern defines areas that form explosively formed projectiles when the explosive is detonated and wherein the pattern repeats at a first angle, wherein the first angle is selected such that the pattern moves in a spiral around the longitudinal axis.

In one embodiment, the pattern repeats at a first angle, wherein the first angle is selected such that the pattern moves in a spiral around the longitudinal axis.

In one embodiment, the pattern is selected to provide an approximately uniform distribution of fragments at a selected distance radially from the cylindrical liner.

In one embodiment, a warhead includes a liner having a longitudinal axis that runs down the center of the liner; a detonator attached to the liner; a bottom end-cap attached to the liner; and an explosive deposited inside the liner. The liner includes a pattern, wherein the pattern is selected to cause the liner to form a plurality of radially expanding projectiles when the explosive is detonated and wherein the pattern is selected to reduce spoking.

In one such embodiment, the warhead has a circular cross-section. In one such embodiment, the liner includes a repeating pattern that repeats in a spiral around the longitudinal axis of the liner. In one such embodiment, the repeating pattern is selected to provide an approximately uniform distribution of fragments at a selected distance radially from the cylindrical liner.

In one such embodiment, the repeating pattern defines areas that form explosively formed projectiles when the explosive is detonated. In one such embodiment, the liner is a preformed fragmentation liner. In one such embodiment, the liner is a controlled fragmentation scored liner.

In one embodiment, a method of manufacturing a liner for a warhead includes selecting a liner shape, wherein the liner shape includes a longitudinal axis; creating a fragmentation pattern; selecting a distance radial to the longitudinal axis; warping the fragmentation pattern as a function of the selected distance and the shape of the liner to reduce the effects of spoking at the selected distance; and forming the liner as a function of the warped fragmentation pattern.

In one such embodiment, selecting the liner shape includes selecting one of a cylinder shape and a tapered cylinder shape. In one such embodiment, selecting the liner shape includes selecting a cylinder shape and wherein warping the fragmentation pattern includes determining an expected fragmentation pattern expected from detonating a warhead with a liner having a cylinder shape.

In one such embodiment, selecting the liner shape includes selecting a tapered cylinder shape and wherein warping the fragmentation pattern includes determining a fragmentation pattern expected from detonating a warhead with a liner having a tapered cylinder shape.

Although the example embodiments described above describe liners that are approximately cylindrical, providing a warp such as a helical twist could be applied to, for example, a tapered cylinder as well. In addition, the mapping software described above can be used to map any desired distribution pattern on any warhead liner in order to achieve a distribution that approximates the desired distribution.

As noted above, a typical fragmentation warhead, upon detonation, produces a radially expanding pattern of fragments. Characteristic of a pattern produced by this type of warhead is an inconsistent linear grouping of fragments otherwise known as "spoking." Spoking reduces the probability of hit on target, thus limiting the lethality of the warhead. The application of this disclosure addresses this problem to produce an even distribution of fragments. An even distribution of fragments enables full lethal potential by maximizing the probability of hit on target. The solution described above addresses these issues.

Although specific embodiments have been illustrated and described herein, it will be appreciated by those of ordinary skill in the art that any arrangement that is calculated to achieve the same purpose may be substituted for the specific embodiments shown. The disclosure may be implemented in various modules and in hardware, software, and various combinations thereof, and any combination of the features described in the examples presented herein is explicitly contemplated as an additional example embodiment. This application is intended to cover any adaptations or variations of the example embodiments of the disclosure described herein. It is intended that this disclosure be limited only by the claims, and the full scope of equivalents thereof.

What is claimed is:

1. A warhead, comprising:

a liner exhibiting an approximately cylindrical peripheral shape and comprising discrete structures directly physically contacting one another and embedded in a potting material in a repeating pattern configured to form a substantially uniform post-detonation fragmentation pattern, the repeating pattern warped at a single angle θ relative to each of a longitudinal axis of the liner and a direction normal to the longitudinal axis such that no phantom lines extending through centers of adjacent discrete structures of the repeating pattern extend parallel to the longitudinal axis or normal to the longitudinal axis;

a forward bulkhead attached to the liner;

an aft bulkhead attached to the liner; and an explosive within a cavity at least partially defined by the liner.

2. The warhead of claim 1, wherein the liner is configured to form explosively formed projectiles from the discrete structures when the explosive is detonated.

3. The warhead of claim 1, wherein the discrete structures comprise discrete ball bearings arranged in a spiral extending around the longitudinal axis.

4. The warhead of claim 1, wherein the single angle θ is selected to give a substantially uniform distribution of post-detonation projectiles at a predetermined distance radially from the liner.

5. The warhead of claim 1, wherein the single angle θ is selected such that the repeating pattern moves in a spiral around the longitudinal axis.

6. The warhead of claim 1, wherein each of the discrete structures exhibits substantially the same geometric configuration.

7. A method of manufacturing a warhead, comprising:

forming a liner exhibiting an approximately cylindrical peripheral shape and comprising discrete structures directly physically contacting one another and embedded in a potting material in a repeating pattern configured to form a substantially uniform post-detonation fragmentation pattern, the repeating pattern warped at a single angle θ relative to each of a longitudinal axis of the liner and a direction normal to the longitudinal axis such that no phantom lines extending through centers of adjacent discrete structures of the repeating pattern extend parallel to the longitudinal axis or normal to the longitudinal axis;

depositing an explosive within a cavity at least partially defined by the liner;

attaching a forward bulkhead to the liner; and attaching an aft bulkhead to the liner.

8. The method of claim 7, wherein forming the liner comprises:

selecting a radial distance from the longitudinal axis;

forming the repeating pattern as a function of the selected radial distance and the shape of the liner to reduce the effects of spoking in the post-detonation fragmentation pattern at a selected distance; and forming the liner as a function of the repeating pattern.

9. The method of claim 7, wherein forming the liner comprises forming the repeating pattern as a spiral that extends at the single angle θ from a line on an outside surface of the cylindrical liner parallel to the longitudinal axis.

10. The method of claim 7, wherein the single angle θ is approximately 15 degrees.

11. A warhead, comprising:

a liner exhibiting an approximately cylindrical peripheral shape and comprising integral and continuous structures exhibiting hexagonal dimples therein and arranged in a repeating pattern configured to form a substantially uniform post-detonation fragmentation pattern, the repeating pattern warped at a single angle θ relative to each of a longitudinal axis of the liner and a direction normal to the longitudinal axis such that no phantom lines extending through centers of adjacent structures of the repeating pattern extend parallel to the longitudinal axis or normal to the longitudinal axis;

a forward bulkhead attached to the liner;

an aft bulkhead attached to the liner; and an explosive within a cavity at least partially defined by the liner.

* * * * *